US011854374B2

(12) United States Patent
Kumagawa et al.

(10) Patent No.: US 11,854,374 B2
(45) Date of Patent: Dec. 26, 2023

(54) EVACUATION GUIDANCE SYSTEM

(71) Applicant: KUMAGAWA CO,. LTD., Hyogo (JP)

(72) Inventors: Keiichi Kumagawa, Hyogo (JP); Shinya Odama, Hyogo (JP); Daisuke Kushida, Tottori (JP)

(73) Assignee: KUMAGAWA CO,. LTD., Hyogo (JP)

( * ) Notice: Subject to any disclaimer, the term of this patent is extended or adjusted under 35 U.S.C. 154(b) by 808 days.

(21) Appl. No.: 16/076,167

(22) PCT Filed: Feb. 8, 2017

(86) PCT No.: PCT/JP2017/004472
§ 371 (c)(1),
(2) Date: Mar. 19, 2021

(87) PCT Pub. No.: WO2017/138543
PCT Pub. Date: Aug. 17, 2017

(65) Prior Publication Data

US 2023/0052031 A1 Feb. 16, 2023

(30) Foreign Application Priority Data

Feb. 9, 2016 (JP) ..... 2016-022521

(51) Int. Cl.
*G08B 5/00* (2006.01)
*G08B 7/06* (2006.01)
(Continued)

(52) U.S. Cl.
CPC ..... *G08B 5/00* (2013.01); *G08B 7/066* (2013.01); *G08B 17/06* (2013.01); *H05B 47/17* (2020.01)

(58) Field of Classification Search
CPC ..... G08B 17/06; G08B 7/066
See application file for complete search history.

(56) References Cited

U.S. PATENT DOCUMENTS 9,898,912 B1 * 2/2018 Jordan, II ..... G08B 21/0446
10,249,158 B1 * 4/2019 Jordan, II ..... G06V 40/172
(Continued)

FOREIGN PATENT DOCUMENTS

JP 01-113080 A 5/1989
JP 2005-165701 A 6/2005
(Continued)

OTHER PUBLICATIONS

International Search Report of PCT/JP2017/004472 dated Mar. 14, 2017.
(Continued)

*Primary Examiner* — Hoi C Lau
(74) *Attorney, Agent, or Firm* — IP BUSINESS SOLUTIONS, LLC

(57) ABSTRACT

An evacuation guidance system is configured from multiple sensor modules, network lines, guidance indicators, and a guidance control device. Each sensor module includes multiple input/output port pairs, fire detection sensors, and a data control unit. The multiple input/output port pairs are connected to input/output port pairs of other sensor modules by means of network lines, thereby configuring a mesh-like autonomous network. The data control unit generates and outputs fire data after adding fire location data; upon receiving fire data, outputs the fire data after adding its own route flag; and stops the output of fire data when the fire data contains its own route flag. Upon identifying the location of the fire outbreak from the fire data, the guidance control device calculates optimum evacuation routes and causes the guidance indicators to turn on/off or flash.

2 Claims, 7 Drawing Sheets

(51) Int. Cl.
*G08B 17/06* (2006.01)
*H05B 47/17* (2020.01)

(56) References Cited

U.S. PATENT DOCUMENTS

| | | | | |
|---|---|---|---|---|
| 10,282,961 | B1 * | 5/2019 | Jordan, II | G06Q 50/163 |
| 10,346,811 | B1 * | 7/2019 | Jordan, II | G08B 21/0461 |
| 10,522,009 | B1 * | 12/2019 | Jordan, II | G06Q 40/08 |
| 10,573,149 | B1 * | 2/2020 | Jordan, II | G06Q 30/01 |
| 10,943,447 | B1 * | 3/2021 | Jordan, II | G08B 21/02 |
| 11,043,098 | B1 * | 6/2021 | Jordan, II | G08B 21/0446 |
| 11,049,078 | B1 * | 6/2021 | Jordan, II | G08B 7/066 |
| 11,334,040 | B2 * | 5/2022 | Jordan, II | G06Q 40/08 |
| 11,514,764 | B2 * | 11/2022 | Correnti | G08B 17/06 |
| 2021/0158664 | A1 * | 5/2021 | Correnti | G06Q 50/163 |
| 2021/0158671 | A1 * | 5/2021 | Jordan, II | H04L 12/2818 |
| 2021/0248883 | A1 * | 8/2021 | Ellis | G08B 7/066 |

FOREIGN PATENT DOCUMENTS

| | | | |
|---|---|---|---|
| JP | 2013-109388 | A | 6/2013 |
| JP | 2014-178937 | A | 9/2014 |
| JP | 2015-84188 | A | 4/2015 |

OTHER PUBLICATIONS

Written Opinion of the International Searching Authority of PCT/JP2017/004472 dated Mar. 14, 2017.

* cited by examiner

EVACUATION GUIDANCE SYSTEM

BACKGROUND OF THE INVENTION

Field of the Invention

The present Invention relates to an evacuation guidance system, and particularly to the system that can safely and reliably guide evacuees in a reliable manner in response to occurrence and spread of fire.

Description of the Related Art

When a fire occurs in a high-rise building such as a building or an apartment, the visibility of person who is trying to evacuate is obstructed by smoke and the evacuation route may be lost sometimes.

Therefore, indicator lights are adopted in high-rise buildings, which are constantly lit to notify the evacuation direction, and it is proposed to adopt a flashing indicator lamp which blinks at the time when a fire occurring to induce evacuation (Patent Document 1), and furthermore it is proposed to induce evacuation by a speaker in addition to indicator lights.

However, when the smoke was full and thickened around evacuee, there was a possibility that the display and blinking itself of indicator lights and flashing indicator lamp become difficult to see and evacuation guidance could not be made.

Meanwhile, it is proposed to provide an evacuation guidance system in a high-rise building, wherein the evacuation guidance system comprises a flash lamp, a fire detector and a control device, the flash lamp is provided in a passage for guiding evacuee to an evacuation place, a fire detector is provided at a predetermined position on each floor, an address is given to the each fire detector. When the fire detector is received self-addressed request signal from a control device, the fire detector returns the detecting data to the control device, and when detecting the occurrence of a fire, the occurring place of fire is identified, the evacuation route and evacuation direction are determined, the flash lamp is blinked according to the evacuation route and evacuation direction so that evacuees can evacuate safely and surely (Patent Document 2).

PRIOR TECHNICAL ART

Patent Literature

Patent Document 1: Japanese Patent Publication No. 2015-84188

Patent Document 2: Japanese Patent Publication No. 2013-109388

However, in the evacuation guidance system described in Patent Document 2, a plurality of fire detectors are provided in each floor, the plurality of fire detectors in each floor are connected in series each other by a transmission line, the transmission lines are connected in parallel every floor to the control device, it seemed to be not assumed that the transmission line may be disconnected due to the occurrence of a fire, and there is concern that the signal from the fire detector may be interrupted and it may not be able to cope with the spread of the fire.

SUMMARY OF THE INVENTION

It is an object of the present Invention to provide an evacuation guidance system that can safely and reliably guide evacuees in a reliable manner in response to occurrence and spread of fire.

Means for Solving the Problem

An evacuation guidance system for displaying and guiding an optimal route toward an evacuation place at the time when a fire occurring is characterized in that;

the evacuation guidance system includes a plurality of sensor modules, a network line, a guiding indicator and a guiding control device, wherein each of the plurality of sensor modules include a plurality of input/output port pairs, a fire detection sensor and a data control unit, the plurality of input/output port pairs are connected to the input/output port pairs of other sensor modules corresponding to the number or less of the input/output port pairs by using the network line, whereby the plurality of sensor modules and the network line constitute a mesh network, and the fire detection sensor is the sensor for detecting a parameter related a fire;

wherein the data control unit creates fire data at the time when the occurrence of a fire is detected by the fire detection sensor, the fire data includes fire place data and fire occurrence data in which fire place data indicates the place of fire occurrence and fire occurrence data indicating the occurrence of fire is added to fire place data, and the fire data is output from the plurality of output port pairs to the other sensor module; and the data control unit sets up a route flag to fire data at the time when the data control unit is input fire data from any one of a plurality of input ports thereof, the route flag indicates that fire data has passed through, and the fire data having a route flag is output from all of the plurality of input/output ports excepting the input/output port pair input fire data to the other sensor modules, and judges whether the self-route flag included or not at the time when the fire data is input to any one of the plurality of input ports, and stops the output of fire data at the time when the self-route flag is included, the guiding indicator is provided on a passageway or wall, the guiding control device specifies an optimum route toward the evacuation place by specifying the fire occurrence place by using fire data at the time when fire data is input, and the guiding indicator is turned on, flashed or blinked along the optimum route.

One of the features of the present Invention is that each of the plurality of input/output port pairs of a plurality of sensor modules are connected to a input/output port pairs of a plurality of other sensor modules by a network line and when a fire occurrence is detected by one sensor module, fire data is created and is output to other sensor module, and other sensor modules output fire data with setting a route flag indicating that the fire data has passed through itself, and the guiding control device determines the optimum route toward the evacuation place by locating the fire occurrence place, and the guiding indicator is turned on, flashed or blinked along the optimum route.

Thus, since the plurality of sensor modules constitute an autonomous mesh network, even if a disconnection occurs in any portion of the network line due to a fire, the fire data are transmitted to other sensor modules one after another so that the plurality of sensor modules can share the fire data and the fire data is reliably given to the guiding control device. Accordingly, the place where the fire occurred can be reliably identified, it is possible to obtain the most optimum route and reliable guidance of evacuation can be performed.

Also, when a spread of fire is sensed by a sensor module, since a plurality of sensor modules share fire data, fire data is reliably given to the guiding control device, and a person who evacuates reliably corresponding to the spread of the fire can be safely and reliably guided to the evacuation place.

The sensor module may have a fire detection sensor, a plurality of input/output port pairs to which a network line is connected, and a data control unit such as a CPU that performs various arithmetic processing, and it is possible to be provided a plurality of CCD cameras that can know the situation of surroundings by imaging, a high luminance LED for performing illumination in the dark, a speaker for guiding evacuation by voice, a microphone for communicating with a guiding control apparatus or an external terminal and a communication terminal for extension, etc.

A temperature sensor, a flame sensor, a smoke sensor, a carbon dioxide sensor, a hydrogen sensor, or the like for detecting a parameter related to a fire can be used as a fire detection sensor. Further, it is possible to provide an acceleration sensor for detecting overturning of the sensor module.

A radio wave beacon reacting with a sensor module is provided on a passage or a wall surface, while a sensor module can be detachable from a network line, and if a evacuee carries it when a fire occurs, it is possible to check where the evacuee is located If the route or direction of evacuation is wrong, attention can be aroused through speakers, and evacuation can be induced more safely.

The fire data can be composed of the self-ID of the sensor module, the command-ID, the data indicating the output state of the fire detection sensor, and the route data including the route flag.

DETAILED DESCRIPTION OF THE INVENTION

Figure 1:
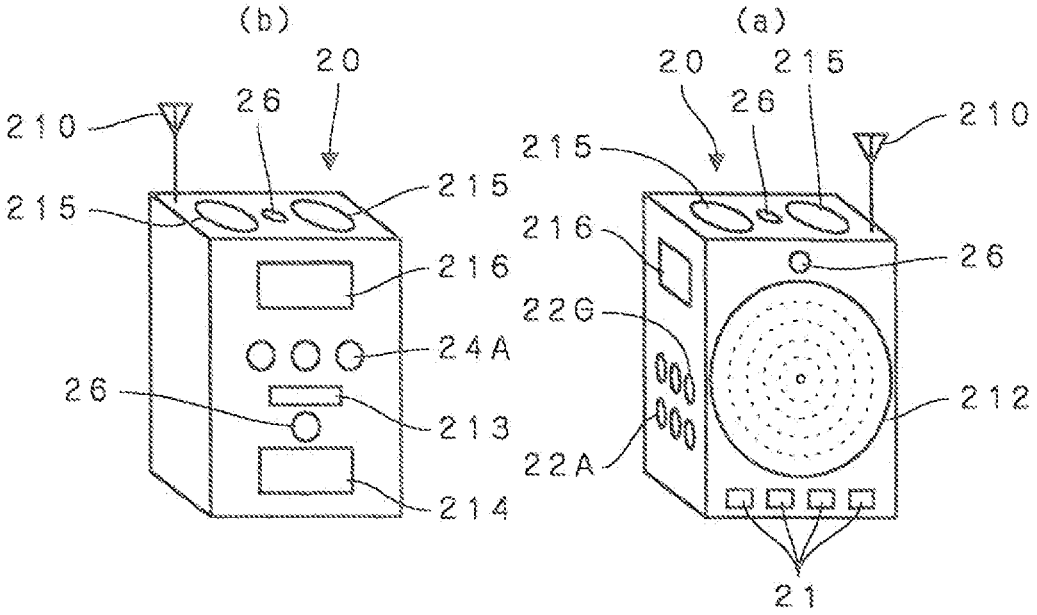
FIG. 1 is a diagram showing the first example of sensor modules in a preferred embodiment of an evacuation guidance system according to the present Invention.

Hereinafter, the present Invention will be described in detail based on specific examples shown in the drawings. FIG. 1 to FIG. 11 show a preferred embodiment of an evacuation guidance system according to the present Invention. The evacuation guidance system 10 includes a plurality of sensor modules 20, a network line 30, a guiding induction lamp (guiding indicator) 40 and a guiding control device 50. The sensor module 20 is installed in an appropriate place such as a room or a corridor.

Figure 2:
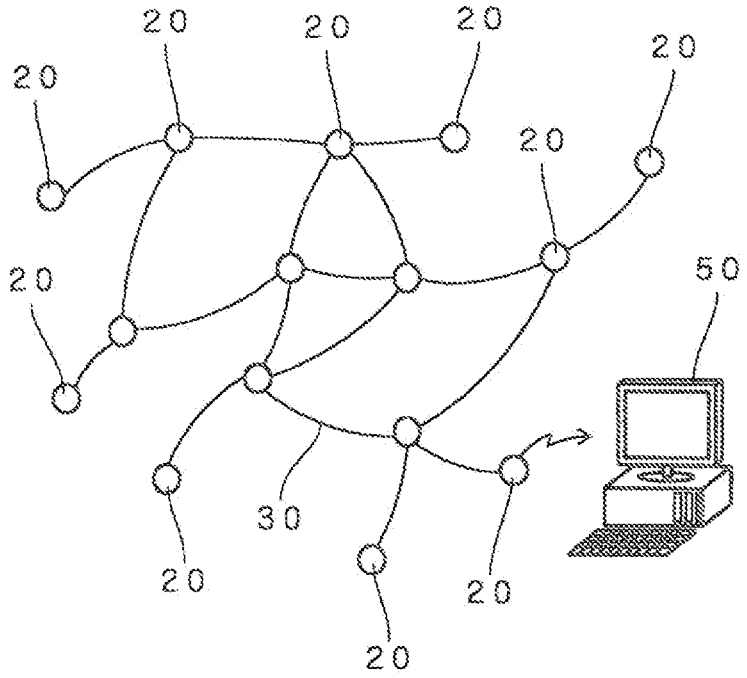
FIG. 2 is a diagram showing the entire configuration of the evacuation guidance system.
Figure 3:
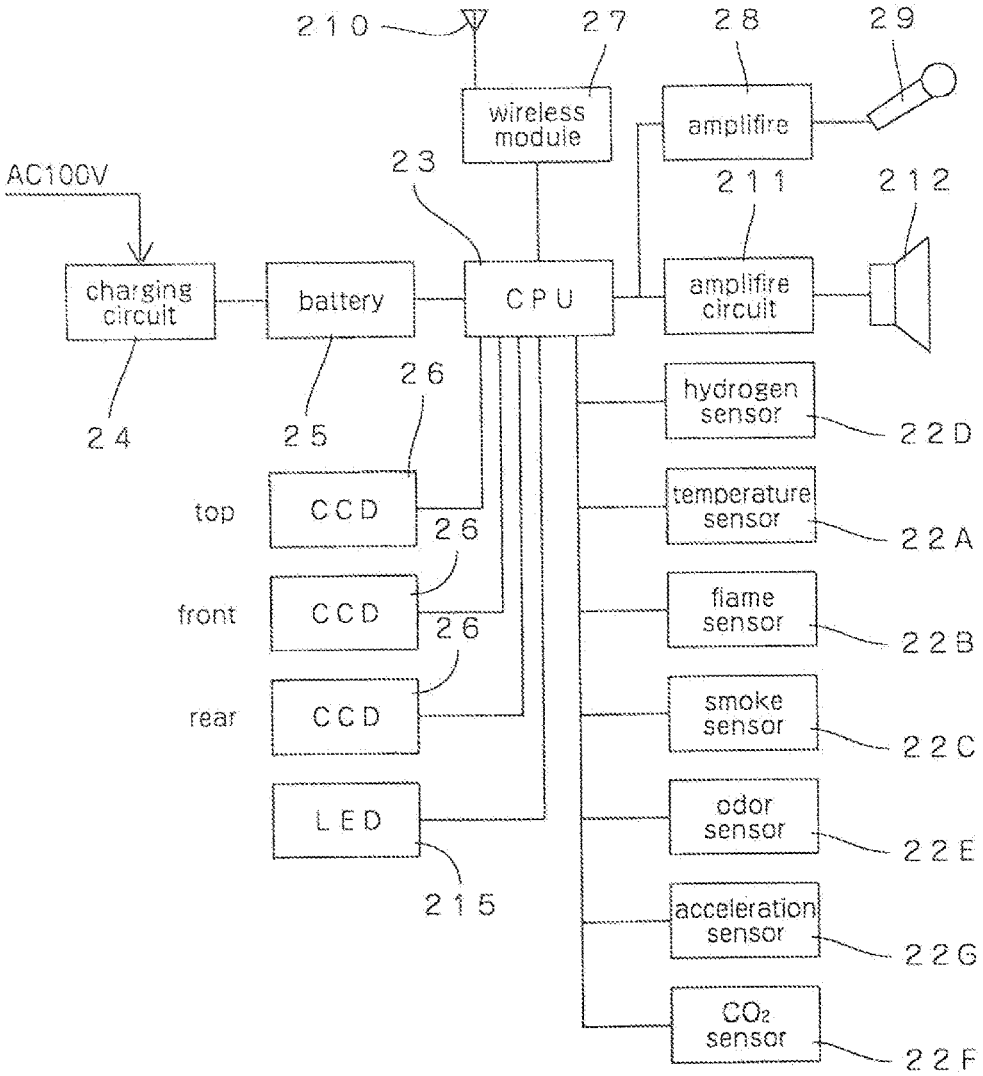
FIG. 3 is a diagram showing a functional configuration of the sensor module.
Figure 4:
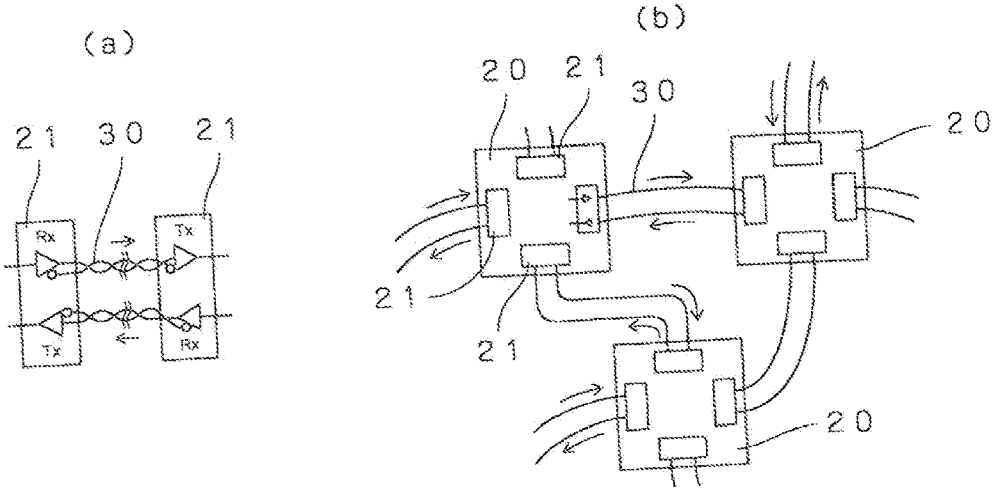
FIG. 4 is a diagram showing a connection relationship of the sensor module.

Each of the plurality of sensor modules 20 includes four input/output port pairs 21, fire detection sensors 22 A to 22 F, an acceleration sensor 22 G, and a control unit (data control unit) 23. As shown in FIG. 4 (*a*) and FIG. 4 (*b*), four input/output ports pairs 21 are connected to the input/output port pairs 21 of the other sensor module 20 corresponding to the number of the input/output port pairs 21 or less by the network line 30, whereby an autonomous mesh-network as shown in FIG. 2 is constituted.

The fire detection sensors 22 A to 22 F are provided with sensors for detecting parameters related to fire, specifically, a temperature sensor 22 A, a flame sensor 22 B, a smoke sensor 22 C, a hydrogen sensor 22 D, an odor sensor 22 E, and a carbon dioxide gas sensor 22 F. And an acceleration sensor 22G is mounted on the sensor module 20 so as to detect falling of the sensor module 20.

A CCD camera 26 for imaging surrounding situations is provided on the top, front and rear surfaces of the sensor module 20, and the sensor module 20 is provided with a charging circuit 24 using a commercial power of 100 V as a power source, a battery 25 to be charged by the charging circuit 24, a control unit 23, an amplifier circuit 211, a speaker 212, a wireless module 27, an antenna 210, an amplifier 28 and a microphone 29.

The control unit 23 is processing as followed; The control unit 23 is composed of a CPU and a necessary storage medium, receives signals from the fire detection sensors 22 A to 22 F, generates fire data that is fire occurrence data indicating the occurrence of a fire added a self-ID indicating fire location data, and outputs the generated fire data from its own four output ports 21 to the other sensor module 20 via the network line 30. And when fire data is input from anyone of four input ports 21, a route flag indicating that the fire data has passed through itself is set up to the input fire data and outputs it toward the other sensor module 20 from all other output ports 21 except the input/output port pair 21 that input the fire data.

Since the terminating sensor module 20 is in a state in which the network line 30 is connected to only one input/output port pair 21, even if fire data is input to the terminating sensor module 20 will never output fire data toward the other sensor modules 20.

The fire data includes a 4-digit self-ID related to a fire occurrence place, a 4-digit command-ID such as a fire data transfer command, a 3-digit temperature data, a 3-digit carbon dioxide concentration data, a 3-digit smoke detection data, a 3-digit flame sensing data, a 3-digit hydrogen sensing data, a 3-digit odor sensing data, and route data (8 bits+256 bits).

Further, when fire data is input from anyone of the plurality of input ports 21, the control unit 23 determines whether or not its own route flag is included, and when including its own root flag, control processing is performed so as to stop the output of the fire data.

Furthermore, when supply of commercial power to the sensor module 20 is interrupted, the control unit 23 performs control processing of the power failure mode 101, turns on the LED 215, and when restoration is performed, performs control processing of the charging mode 100. On the other hand, when the control process of the power failure mode 101 is performed, the network line 30 is disconnected from the sensor module 20 performing control processing of the power failure mode 101, control processing of the emergency guidance mode 103 is performed, the CCD camera 25 is turned on, and the LED 215 is turned on.

When the fire data is input, the control unit 23 performs the control process of the fire mode 102, turns on the CCD camera 25, turns on the LED 215, and when the network line 30 is removed from the sensor module 20 in performing the control process of the fire mode 102, control processing of the emergency guidance mode 103 is performed, the CCD camera 25 is turned on, and the LED 215 is turned on.

When the filling voltage decreases in the emergency guidance mode 103, the control unit 23 returns to the charging mode 100, whereas if the charging voltage is sufficient, the control unit 23 shifts to the autonomous guiding mode 104 and performs control processing of the autonomous guiding mode 104.

Figure 7:
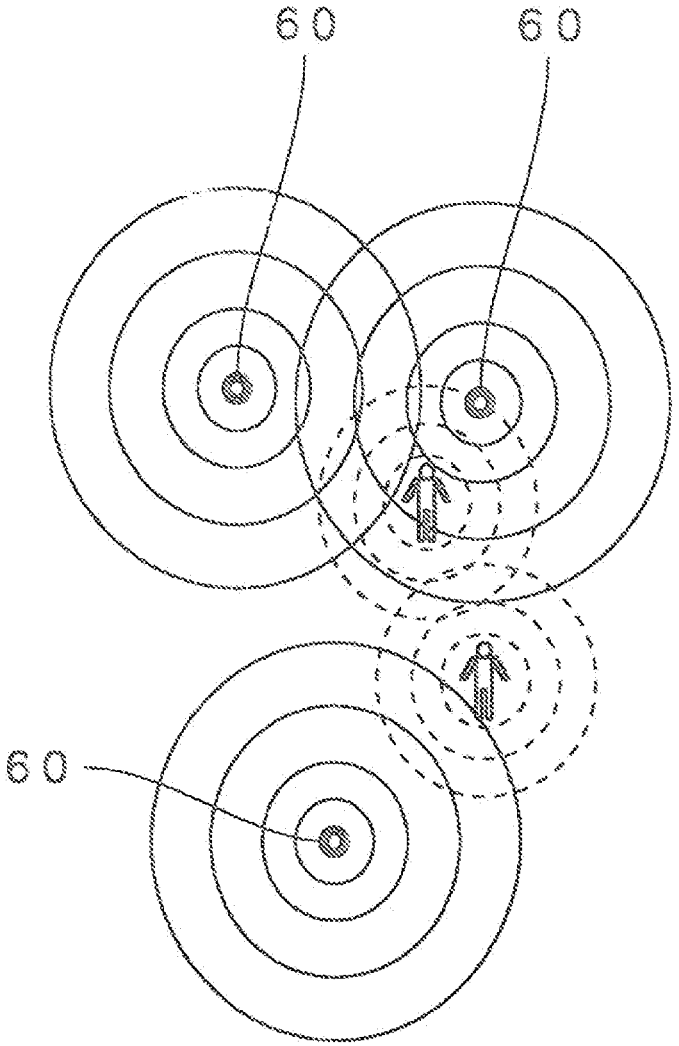
FIG. 7 is a diagram schematically showing a method of position detection by a radio wave beacon in the evacuation guidance system.
Figure 8:
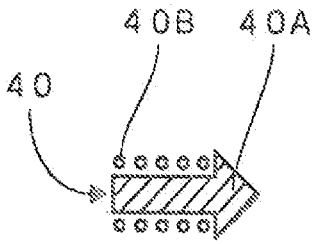
FIG. 8 is a diagram showing an example of a guidance indication lamp in the evacuation guidance system.
Figure 9:
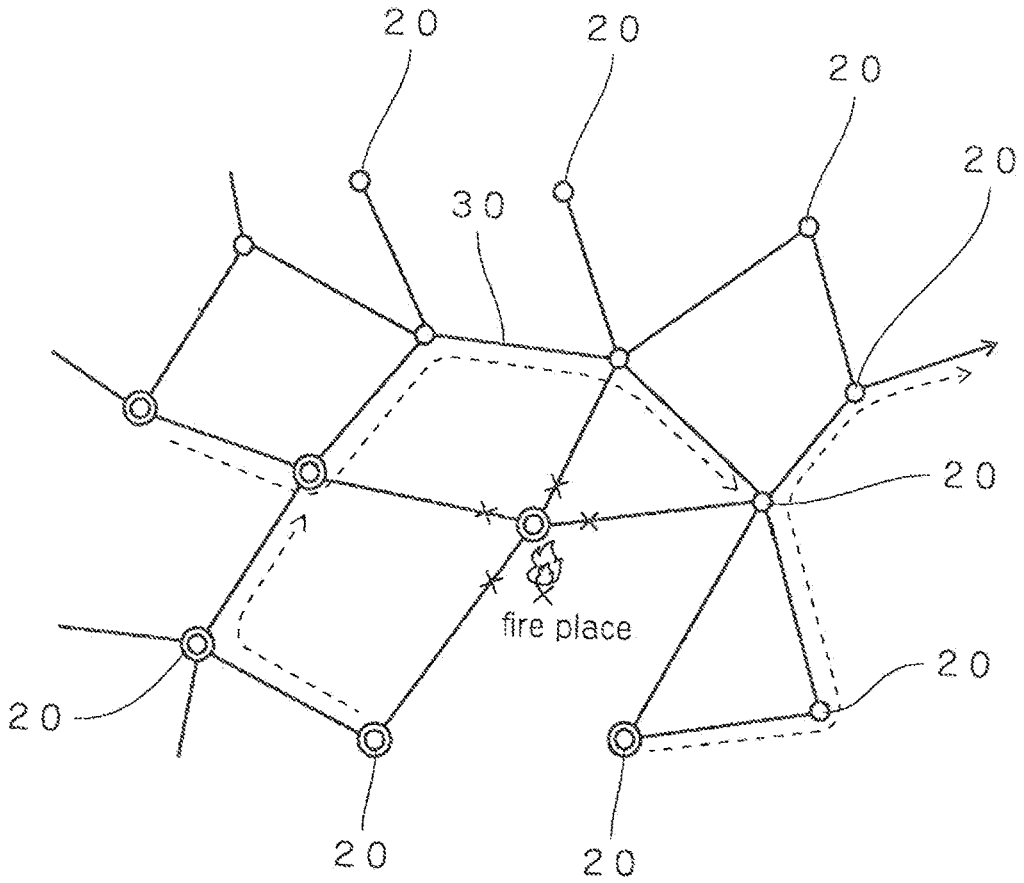
FIG. 9 is a diagram showing the operation of the autonomous network of the evacuation guidance system.

The guiding induction lamp 40 is composed of a visible LED 40 A in the form of an arrow and a point infrared LED 40 B and is embedded in a ceiling wall surface, a passage wall surface, a corridor, and a radio wave beacon sensor 60 is buried in the ceiling wall surface. As shown in FIG. 7, the radio wave beacon sensor 60 gives the signal of the adjacent radio beacon to the sensor module 20, receives the response signal with the sensor, and detects the position of the sensor module 20 according to the strength of the response signal intensity.

When the guiding control device 50 receives the fire data in the form of the radio signal from the sensor module 20 and detects the occurrence of a fire from the fire data, the guiding control device 50 specifies the place of fire occurrence from the self-ID of the sensor module 20 that created the fire data. And the guiding control device 50 finds a safe route toward the evacuation place, turns on the visible light LED 40A of the guiding induction lamp 40 corresponding to the safe route, flashes the infrared light LED 40B. And if the guiding control device 50 receives new fire data due to spread of the fire, identifies the place of the fire occurrence and obtains a new safe route to the evacuation, turns on the visible light LED 40A of the guiding indication lamp 40 corresponding to the new safe route and flashes the infrared light LED 40B.

The route toward the evacuation place may be determined by map operation, or it may be determined by functional calculation using position, safety factor, or the like.

Furthermore, the guiding control device 50 executes the control process of the autonomous induction mode 104, detects the position of the sensor module 20, that is, the position of the evacuee by using the radio wave beacon 60, and performs evacuation guidance, when the guidance becomes impossible, the control processing of the remote guidance mode 105 is executed, the voice is transmitted to the sensor module 20 in the form of the radio signal, and evacuation guidance is performed by using the voice through the speaker 212 of the sensor module 20.

Figure 6:
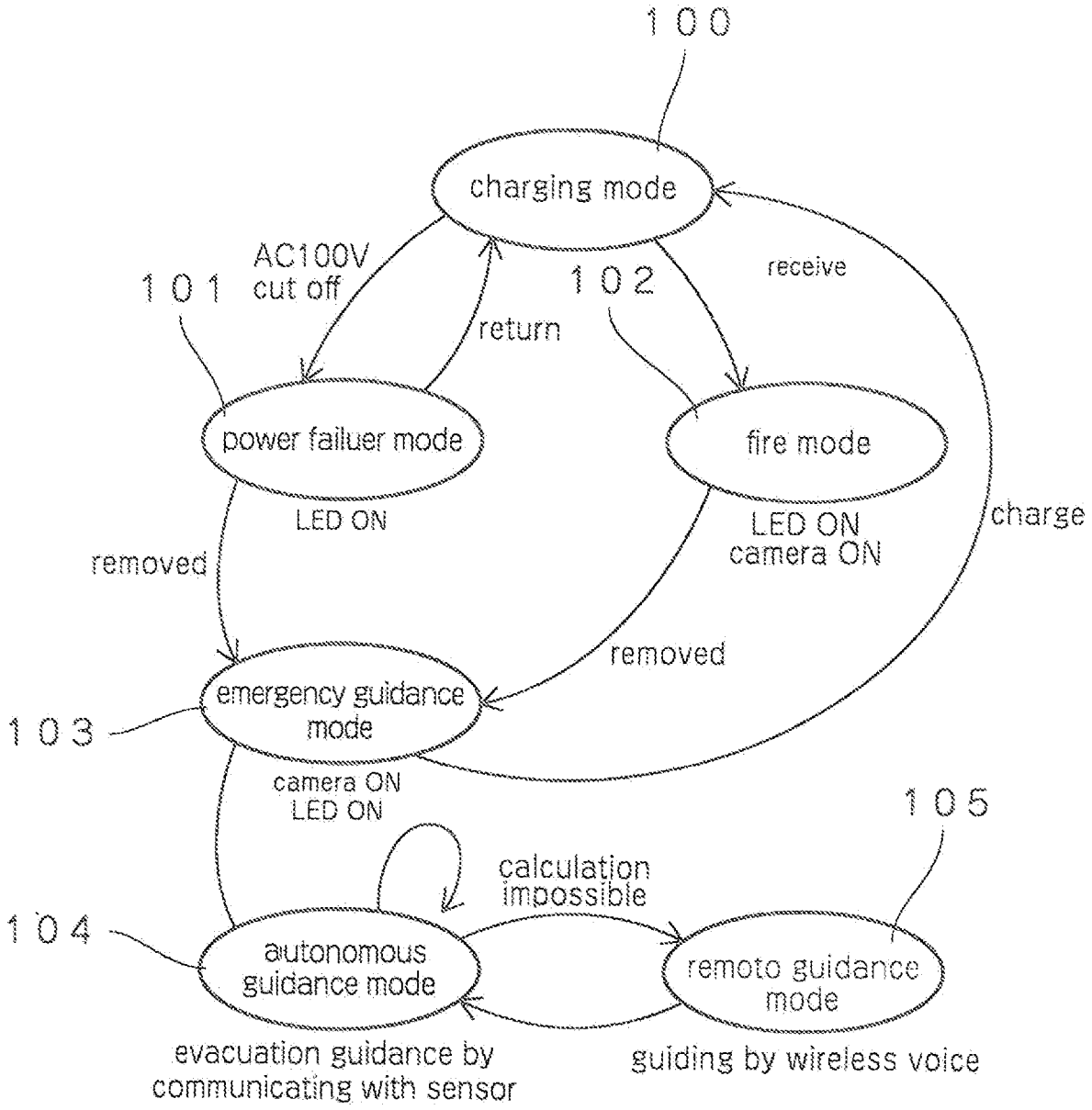
FIG. 6 is a diagram schematically showing a concept of control processing in the evacuation guidance system.

Now, the operation of system will be described. As shown in FIG. 6, in the plurality of sensor modules 20, control processing of the charging mode 100 is normally performed, and the charging circuit 24 charges the battery 25 by using the commercial power supply as a power source. On the other hand, when the commercial power supply breaks down, the control process of the power failure mode 101 is performed to turn on the LED 215 of the sensor module 20 to illuminate the power failure and to notify the power failure. When the commercial power source returns to the original state, the control process of the charging mode 100 is restored, and the LED 215 of the sensor module 20 is turned off.

Further, the sensor module 20 constantly monitors the signals of the fire detection sensors 22A to 22F. When a fire occurs near the sensor module 20, it is determined that a fire has occurred from changing the sensor signal, and the fire mode 102 is performed, fire data is created, the CCD camera 26 is operated to takes a surrounding situation, transmits it to the guiding control device 50 as a radio signal, and turns on the LED 215 to perform illumination.

Fire data has a structure which comprised self-ID, command-ID, temperature data, carbon dioxide as concentration data, smoke sensing data, hydrogen sensing data, odor data and route data, and this fire data is output from four output ports 21 to another sensor module 20.

In the sensor module 20 having received the fire data, the control process of the fire mode 102 is executed, and it is judged whether or not the route flag is set up in the own bit number of the route data among the received fire data, and when the route flag is not set up, the route flag is set up to the predetermined bit number of his own the route data among the received fire data and this fire data is output from the remaining output port except the input/output port pair 21 to which the fire data is input/output port 21 toward another sensor module 20. But, if the route flag is set on its own bit number, the output of the fire data is stopped, whereby all of the plurality of sensor modules 20 may share the fire data.

Figure 5:
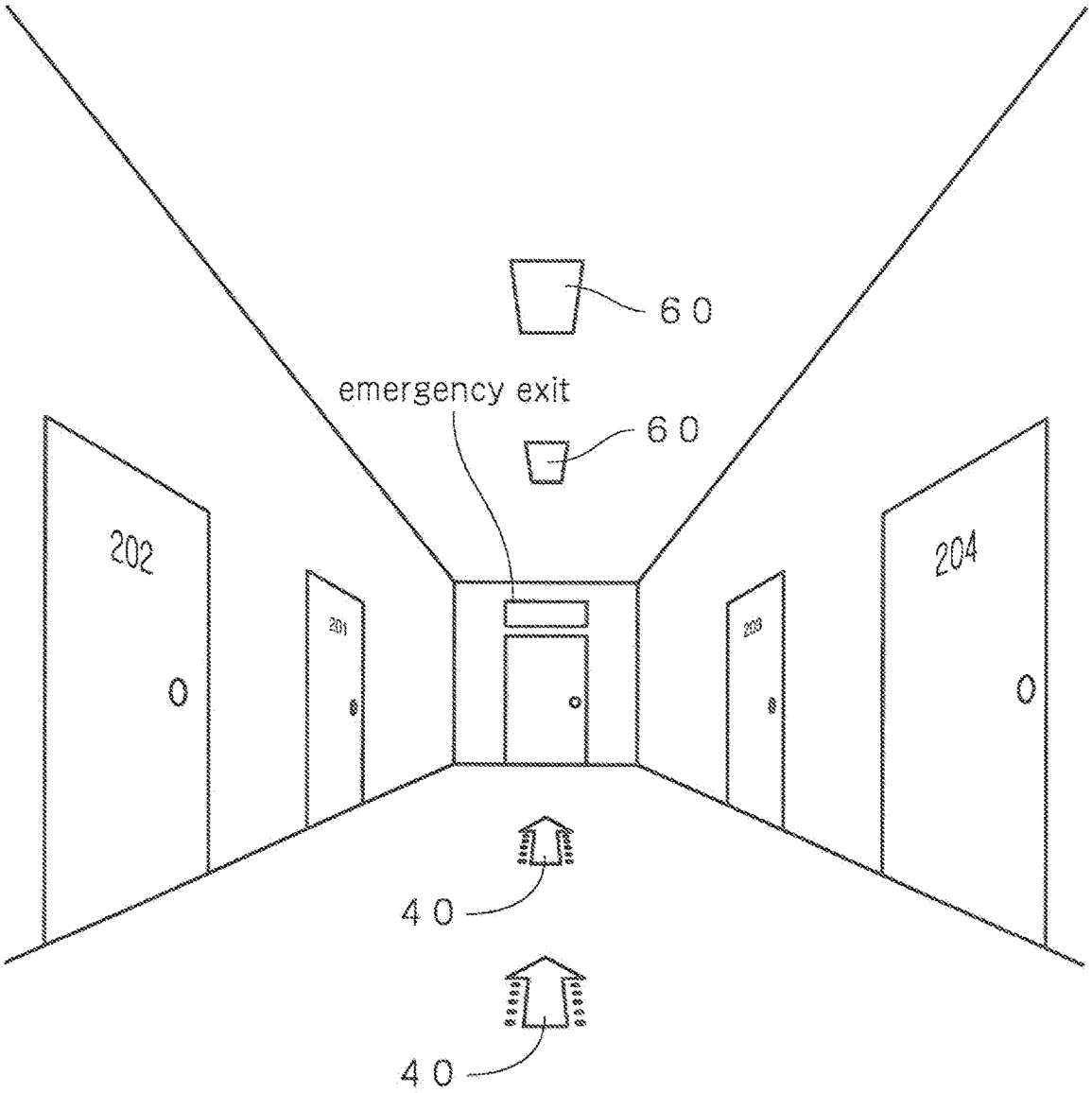
FIG. 5 is a view showing an installation example of a radio wave beacon and guidance indicating lamp in the evacuation guidance system.

If it is cut off anywhere on the network line 30, it is concerned that transmission and reception of fire data will be interrupted. However, in the system of the present example, the sensor modules 20 and the network line 30 constitute a mesh network as shown in FIG. 5, it is possible to reliably give the fire data to all the other sensor modules 20 through other paths except for the disconnection point of the network line 30 as shown in FIG. 5.

In performing the control process of the fire mode 102, the guiding control device 50 receives fire data from the sensor module 20 in the form of radio signal, identifies the fire occurrence place from place of the sensor module 20 that created the fire data, and determines the safe route toward the evacuation place, turns on the visible light to LED 40A of the guiding indication lamp 40 corresponding to the safe route, and flashes the infrared light LED 40B.

When the sensor module 20 is removed from the network line 30 in performing the control process of the fire mode 102, the performing process is shift to the control process of the emergency guidance mode 103, the CCD camera 26 is operated to capture the surrounding situations and the data of the CCD camera 26 is sent to the guiding control device 50 in the form of the radio signal, and turns on the LED 215 to perform illumination.

Figure 10:
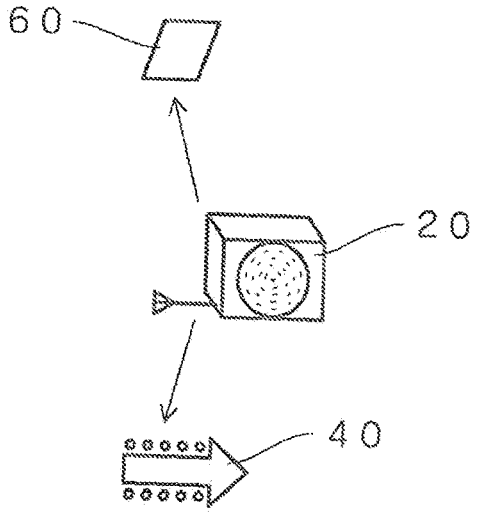
FIG. 10 is a view showing the concept of the autonomous guiding mode in the evacuation guidance system.

When the CCD camera 26 is activated and the LED 215 is turned on, the performing process is shift from the emergency guidance mode 103 to the control process of the autonomous guiding mode 10 and since the evacuee is evacuated carrying with the sensor module 20, as shown in FIG. 10, the position of the sensor module 20 is identified by comparing the signal strength of the radio wave beacon sensor 60, and the guiding induction light 40 is turned on and blinked to guide the evacuee.

Figure 11:
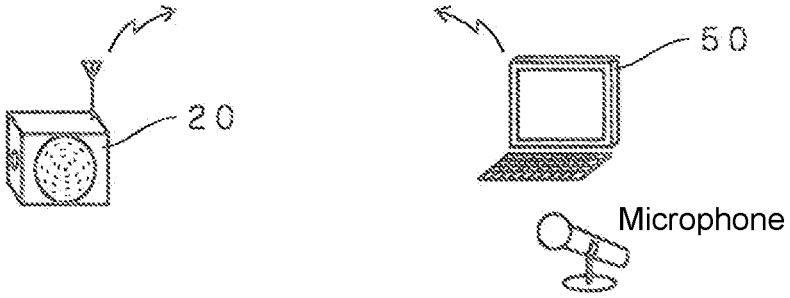
FIG. 11 is a diagram showing a concept of a remote guiding mode in the evacuation guidance system.

If calculation using the signal from the sensor module 20 becomes impossible in performing the control process of the autonomous guiding mode 104, guiding evacuation by using the sensor module 20 becomes more difficult. In such a case, the control process of the remote guiding mode 105 is started to perform, as shown in FIG. 11, the guiding control device 50 and the sensor module 20 are wireless connected to each other, and staff members such as fire brigade members voice-guide evacuation routes by microphone.

When evacuee evacuates to a place where calculation can be performed in the guiding control device 50, the evacuation guidance returns to the autonomous guiding mode 104, and guiding evacuation is performed by the control process of the autonomous guiding mode 104.

In normal operation, the guiding control device 50 regularly supplies dummy fire data to the sensor module 20, and monitors whether the autonomous network is normal or not

BRIEF DESCRIPTION OF SIGN

20 sensor module
21 I/O port pair
22 A to 22 F fire detection sensor
23 control unit (data control unit)
30 network line
40 guiding indicator light
50 guiding control device

The invention claimed is:

1. An evacuation guidance system for displaying and guiding an optimal route toward an evacuation place at a time of fire comprising:

a plurality of sensor modules, a network line, a guiding indicator, and a guiding control device, wherein each of the plurality of sensor modules includes a plurality of input/output port pairs, a fire detection sensor, and a data control unit, and the plurality of input/output port pairs are connected to the input/output port pairs of other sensor modules corresponding to the number or less of the input/output port pairs by using the network line, whereby the plurality of sensor modules and the network line constitute a mesh network, and the fire detection sensor is the sensor for detecting a parameter related a fire;

wherein the data control unit creates fire data at the time when the occurrence of a fire is detected by the fire detection sensor, the fire data includes fire place data and fire occurrence data in which fire place data indicates the place of fire occurrence and fire occurrence data indicating the occurrence of fire is added to fire place data, and the fire data is output from the plurality of output port pairs to the other sensor module; and the data control unit sets up a route flag including a self-route flag to fire data at the time when the data control unit is input fire data from at least one of a plurality of input ports thereof, the route flag indicates that fire data has passed through, and the fire data having the route flag is output from all of the plurality of input/output ports excepting the input/output port pair input fire data to the other sensor modules, and judges whether or not the self-route flag included at the time when the fire data is input to at least one of the plurality of input ports, and stops the output of fire data at the time when the self-route flag is included, the guiding indicator is provided on a passageway or wall, the guiding control device specifies an optimum route toward the evacuation place by specifying the fire occurrence place by using fire data at the time when fire data is input, and the guiding indicator is turned on, flashed or blinked along the optimum route, and when new fire data is input by the data control unit of other sensor module, spread of fire is detected from the input fire data to specify the optimum route toward the evacuation place, the guiding indicator is lit up, flashed or blinked along the specified optimum route.

2. The evacuation guidance system according to claim 1, wherein the sensor module and the guiding control device are wireless connected to each other so as to give voice guidance from the guiding control device to the sensor module.

* * * * *